US007645001B2

(12) United States Patent
Harris

(10) Patent No.: US 7,645,001 B2
(45) Date of Patent: Jan. 12, 2010

(54) LOCKER SHELF

(75) Inventor: Jerry Harris, Cuba, MO (US)

(73) Assignee: Industrial Wire Products, Inc., Sullivan, MO (US)

( * ) Notice: Subject to any disclaimer, the term of this patent is extended or adjusted under 35 U.S.C. 154(b) by 861 days.

(21) Appl. No.: 11/349,685

(22) Filed: Feb. 8, 2006

(65) Prior Publication Data

US 2006/0186769 A1 Aug. 24, 2006

Related U.S. Application Data

(60) Provisional application No. 60/655,874, filed on Feb. 24, 2005.

(51) Int. Cl.
*A47B 45/00* (2006.01)

(52) U.S. Cl. ..... 312/205

(58) Field of Classification Search ..... 312/305, 312/351, 408, 410, 205, 257.1; 108/102, 108/137, 143; 211/153
See application file for complete search history.

(56) References Cited

U.S. PATENT DOCUMENTS 4,193,650 A * 3/1980 Gray et al. ..... 312/205
4,500,146 A 2/1985 Peterson
4,607,455 A 8/1986 Bluem et al.
4,677,791 A 7/1987 Larson et al.
5,137,160 A 8/1992 Santucci
5,221,013 A * 6/1993 Santucci ..... 211/153
D355,551 S 2/1995 McNamara et al.
5,421,646 A 6/1995 McNamara et al.
5,806,945 A * 9/1998 Anderson et al. ..... 312/265.3
6,279,756 B1 * 8/2001 Walter et al. ..... 211/26
2004/0164655 A1 * 8/2004 Wood et al. ..... 312/205

FOREIGN PATENT DOCUMENTS

GB 178984 * 5/1922

* cited by examiner

*Primary Examiner*—James O Hansen
(74) *Attorney, Agent, or Firm*—Paul M. Denk

(57) ABSTRACT

A shelf having two telescoping plates secured by a toothed crank is provided for locker users. The plates have a generally rectangular shape with perimeter edges reinforced by lips and pads to engage the locker walls. Friction between the pads and the walls holds the present invention at a desired elevation. This shelf has a toothed rack upon a first plate and a crank with teeth upon the second plate. The teeth upon the crank engage the rack and turning of the crank secures the second plate relative to the first plate longitudinally at a desired width for fitting against the inner walls of a locker.

2 Claims, 3 Drawing Sheets

LOCKER SHELF

CROSS REFERENCE TO REALTED APPLICATION

This nonprovisional patent application claims priority to the provisional patent application having Ser. No. 60/655,874, which was filed on Feb. 24, 2005.

BACKGROUND OF THE INVENTION

This invention relates generally to shelving and more specifically to a longitudinally extendable shelf.

People often need to store items when moving outside to inside of a building or between work areas within a building. Students store coats and books in lockers at school while workers store outerwear and tools in lockers at a workplace. Further athletes store clothing and other items in lockers at athletic facilities of all kinds.

The typical locker has, behind the door, one shelf at nearly eye level. Students and athletes can quickly fill a single shelf. Other lockers, often in workplaces, lack shelving. Workers merely stack items within those lockers. The clever students and workers provide and construct additional shelving for their lockers. Such shelving can be plywood plates upon pins in the walls of a locker, milk crates, or other paneling simply supported. Existing shelving typically has a fixed size, usually suitable for one locker alone. Further students and workers provide such shelving at their own expense and labor.

DESCRIPTION OF THE PRIOR ART

Various types of shelves and components have been available for the storage industry. The prior art shelves fit within lockers and attach to the walls of a locker in a variety of ways. Adjustable gates provide a mechanism to extend portions of the gate lengthwise. Some mechanisms use ratcheting teeth or screws to secure or to extend a gate or shelf.

For example, the patent to Bluem, et al., and assigned to North States Industries, Inc., U.S. Pat. No. 4,607,455 first shows handle gear related to the present invention. This expired patent covers an adjustable gate for doorways.

The patent to Larson et al., also assigned to North States Industries, Inc., U.S. Pat. No. 4,677,791 relates to the adjustable gate for a doorway, but more specifically pertains to the mounting socket.

The design patent to McNamara et al., assigned to Minnesota American, Inc., U.S. Pat. No. Des. 355,551, illustrates a legless locker shelf assembly. Though this particular locker shelf expands, the appearance and structure of this patented device is just totally dissimilar from the appearance and function of the present invention.

Earlier, the patent to Peterson, assigned to Sioux Technology Inc., U.S. Pat. No. 4,500,146 shows the use of shelving, which is expandable, and which can be forced against the interior walls of a locker, to furnish supplemental storage.

Then the patent to McNamara et al., assigned to Minnesota American, Inc., U.S. Pat. No. 5,421,646, describes another legless locker shelf assembly. In this assembly, the side walls of its first and second shelf members have releasable cooperating holding means that retain the first and second shelf members in expanded positions. These holding means, associated with the side walls, are the operating ratchet teeth that hold the shelves separated when they are expanded. While the ratchet teeth may be releasable, they are intended to retain the first and second shelf members in an expanded position, once expanded. The present invention does not show or disclose any type of that structure. The shelves of the present invention are free to slide into expansion or contraction, all the time, and are not held in expanded position, by anything operatively connected with its side walls.

And, McNamara '646 defines the releasable cooperating holding means as the first and second sets of ratchet teeth, operatively cooperating with the side walls. This is not the structure of the present invention. The present invention lacks the side walls that have these engaging ratchet teeth. McNamara '646 goes on to define a cam actuator means having a spiral-shaped outer portion that engages with at least one of the cam follower teeth that are attached to the top of the shelf. FIGS. 8 and 9, of the '646 patent, once again, show that the cam follower teeth are forced into expansion by the outer end portion of the spiral cam actuator.

And, the patent to Santucci, No. U.S. Pat. No. 5,137,160 describes a self supporting locker shelf similar to the present invention. The Santucci '160 patent defines a self-supporting locker shelf comprised of first and second planar and rectangular shelf members, attached to each other for pivotal movement. The present invention has linear or longitudinal movement for its shelves, relative to each other, and not pivotal movement.

SUMMARY OF THE INVENTION

This invention generally defines a shelf having two telescoping plates controlled by a toothed crank and a rack. The plates have a generally rectangular shape with perimeter edges reinforced by downturned lips. The outer edges of the plates have pads to abut the interior walls of a locker. Friction between the pads and the walls holds the present invention, under a load, at a desired elevation within the locker.

More specifically, this locker shelf has a toothed rack upon a first plate and a crank with teeth upon the second plate. The teeth upon the crank engage the rack and turning of the crank secures the second plate relative to the first plate longitudinally. Using the crank, the first plate and the second plate attain an overall width that adjusts to meet the width presented by the interior of a locker.

Further this locker shelf has the rack and crank generally located in the center of the invention and upon the lower surface of the respective plates. The plates have an open grid pattern flanking the rack and crank to allow for ventilation and display of the interior of the locker.

This therefore is the principal object of the present invention to secure two aligned plates extending across the interior width of various lockers.

Another object of this invention is to provide a shelf that extends without use of tools.

Still another object of this invention is to provide a shelf that does not permanently attach to a locker, and can be readjusted to other positions.

Still another object is to provide such a shelf that can be easily and efficiently manufactured and marketed to the consuming public.

These and other objects may become more apparent to those skilled in the art upon review of the summary of the invention as provided herein, and upon. undertaking a study of the description of the preferred embodiment in view of the drawings.

BRIEF DESCRIPTION OF THE DRAWINGS

In referring to the drawings.

Corresponding reference numerals will be used throughout the several figures of the drawings.

DESCRIPTION OF THE PREFERRED EMBODIMENT

Figure 1:
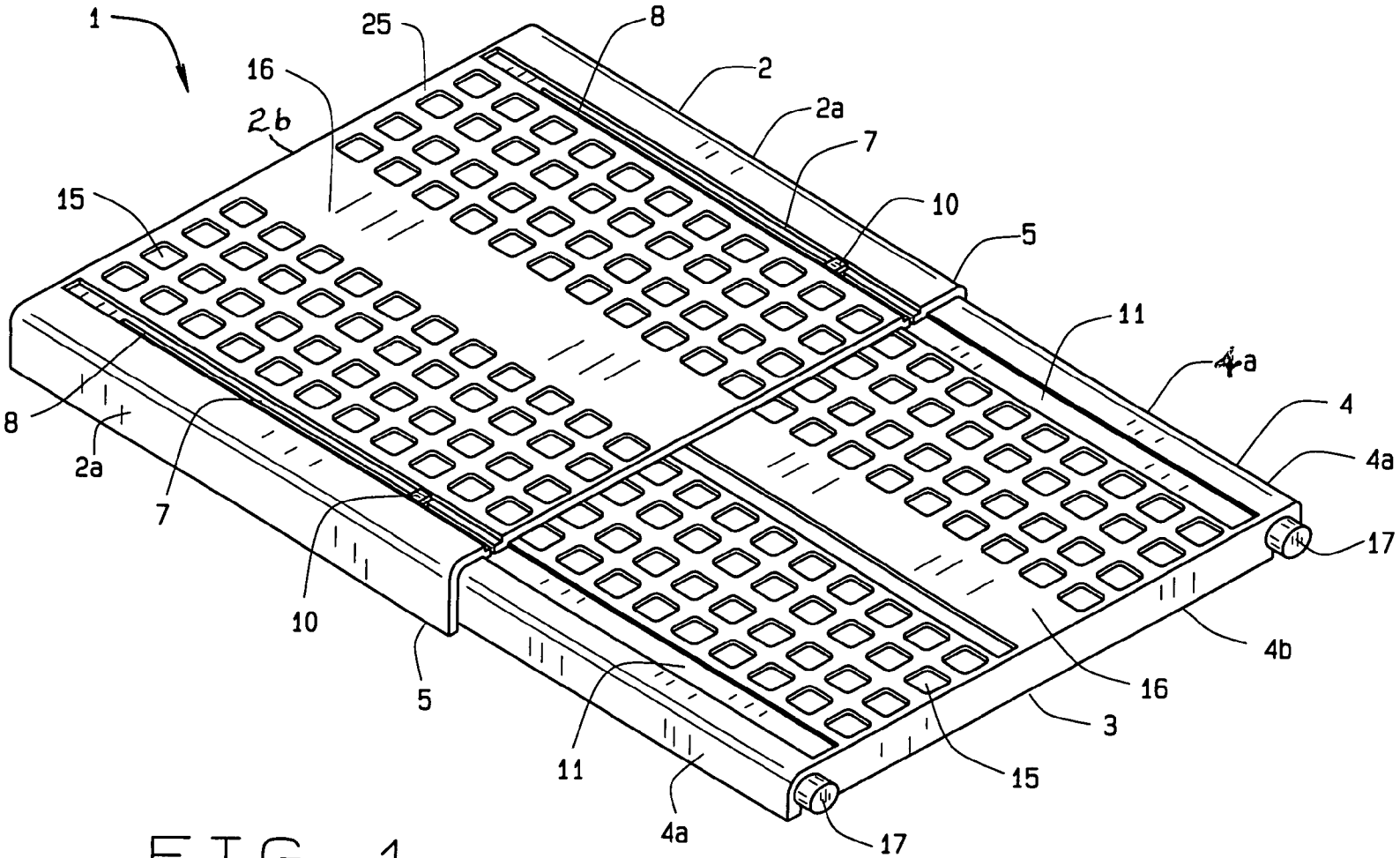
FIG. 1 shows an isometric top view of the locker shelf.

In referring to FIG. 1 of the drawings, the concept of this invention or device 1 is readily disclosed. The device 1 includes, as depicted therein, a first plate 2 generally rectangular in shape and a second plate 4 that extends from the first plate 2. The second plate 4 has a slightly narrower width than the first plate 2. Each plate has a turned down edge or lip 3 upon three or more perimeter sides. The first plate 2 has two longitudinal edges 2*a* and one lateral edge 2*b* perpendicular to the longitudinal edges 2*a*. The second plate 4 also has two mutually parallel spaced apart longitudinal edges 4*a* but two mutually parallel spaced apart lateral edges 4*b* perpendicular to the longitudinal edges 4*a*. The lips 3 reinforce the perimeter of the shelf 1 and increase rigidity of the shelf 1 when under load. Upon the outer lips 3 of each plate, two or more pads 17 extend further outward to grasp the wall of a locker. The pads 17 have a generally round shape and secure into slots within the lip 3. The slots open downward so the shelf 1 remains on the pads 17 when upright and under a load. In the preferred embodiment, each plate has an open pattern of holes 15 flanking the longitudinal axis. The holes 15 provide ventilation and allow the user to see through the shelf 1 if needed. Centered between the holes 15, each plate has a solid longitudinal strip or spine 16 that conceals a means to secure or securing mechanism 6 of the shelf 1. Flanking the spine 16, the first plate 2 has two spaced apart and mutually parallel tracks 7 visible upon the top surface. The tracks 7 have a lengthwise slot 8 and run in the longitudinal direction of the shelf 1.

Figure 2:
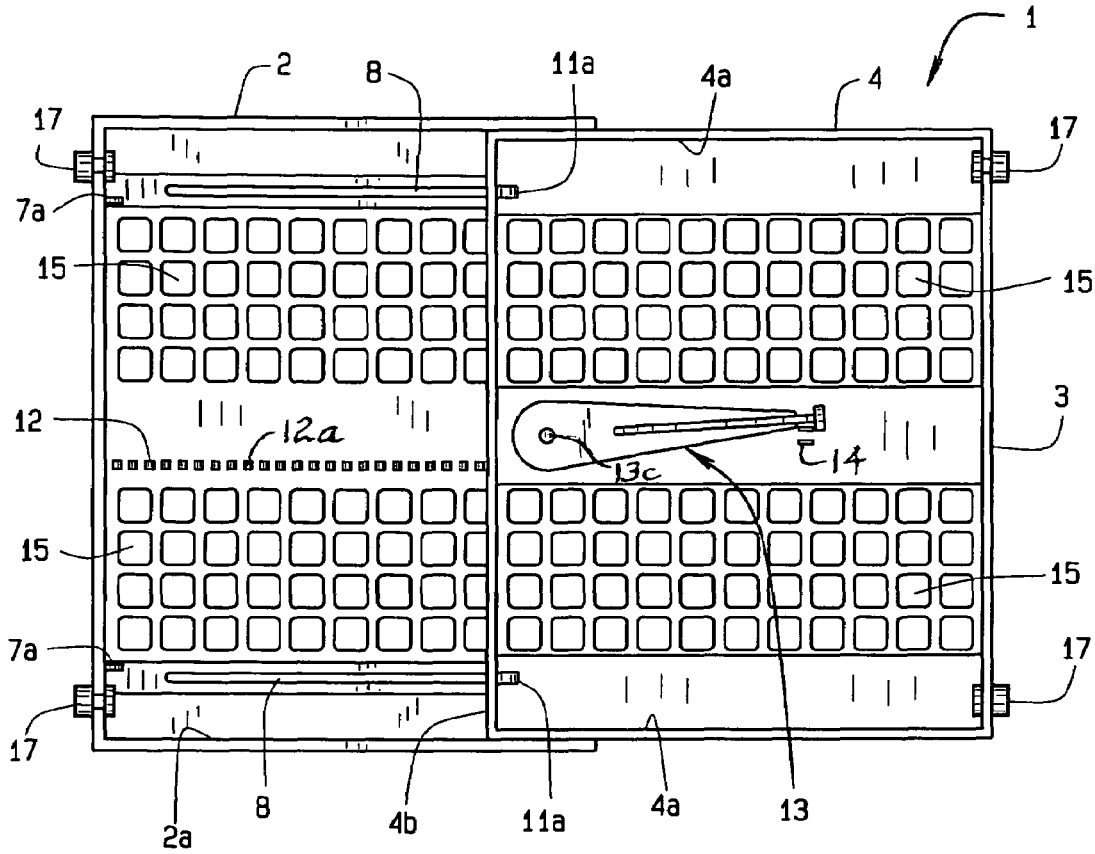
FIG. 2 shows an isometric bottom view of the present invention.

The securing mechanism appears in FIG. 2 beneath the spine 16 of both plates. Beneath the first plate 2, the securing mechanism has a toothed rack 12. The rack 12 extends longitudinally. The teeth 12*a* are adjacent to a pattern of holes 15 upon one side of the spine 16. Corresponding to the teeth 12*a*, a crank 13 beneath the second plate 4 secures the second plate 4 relative to the first plate 2 when turned. The crank 13 has a handle 13*d* offset from a head 13*a* later shown in FIG. 5. Opposite from the head 13*a*, the handle 13*d* approaches a pair of stops 14. The stops 14 are mutually spaced apart for a snug fit of the handle 13*d*. When engaged, the stops 14 prevent the handle 13*d* from rotating when the shelf 1 is secured.

Also beneath the first plate 2, a gusset 7*a* supports each track 7 upon which the second plate 4 slides. The tracks 7 serve as one component of a means for telescoping 5 the second plate 4 longitudinally from the first plate 2. Upon the other end of each track 7, the first plate 2 has a glide 8. The glides 8 are located at the lower edge of the lips 3 on the edges 2*a* also parallel to the longitudinal direction of the shelf 1. The glides 8 support the lips 3 on the longitudinal edges 4*a* of the second plate 4 and form a load bearing connection of the second plate 4 to the first plate 2 at any width of the shelf. Moving to the second plate 4 and opposite the pads 17, gussets 7*a* support the keys 10 extending above the second plate 4 collinear with the tracks 7 of the first plate 2.

Figure 3:
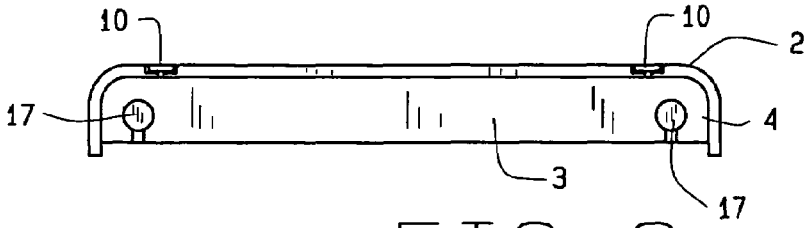
FIG. 3 provides an isometric top view of the second plate.

The keys 10 of the second plate 4 appear more clearly in FIG. 3. Upon the top surface of the second plate 4, two depressed parallel grooves 11 run. Opposite the pads 17, each groove 11 has a key 10. The key 10 has a generally T shaped cross section that engages the groove 11 upon the first plate 2. The keys 10 and grooves 11 cooperate to extend the second plate 4 longitudinally from the first plate 2 while maintaining a structural connection between the plates. Generally centered between the keys 10, the head 13*a* is located upon the spine 16 opposite the pads 17. The head 13*a* has a generally round flat shape with two or more teeth 13*b* radially disposed upon the circumference of the head 13*a*. In the preferred embodiment, the head 13*a* has three teeth 13*b* regularly spaced so the teeth 13*b* permit partial rotation of the handle 13*d* when engaging the rack 12. The rotation of the crank 13 induces extension of the second plate 4 slightly from the first plate 2 for a friction fit.

Figure 4:
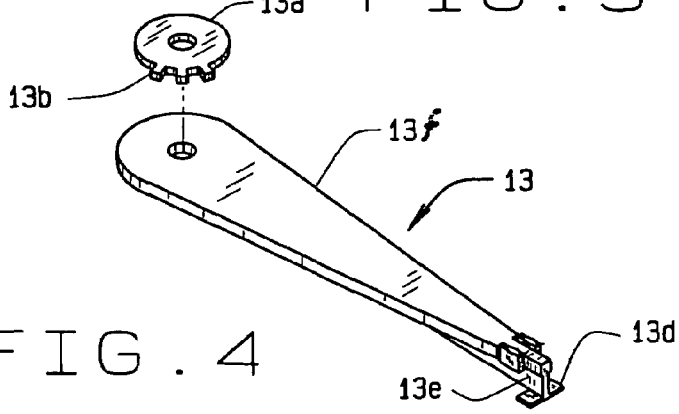
FIG. 4 describes an isometric bottom view of the second plate.

Turning beneath the second plate 4, FIG. 4 shows the handle 13*d* of the crank 13. The handle 13*d* has a tapered elongated shape with a grip 13*f* upon one end. Opposite the grip 13*f*, a hole admits the stem 13*c* of the head 13*a*. With a lip adjacent to the stem 13*c*, the crank 13 can rotate within 180° when moving the second plate 4 relative to the first plate 2. Proximate to the pads 17 and opposite of the keys 10, gussets 11*a* support the outer corners of the second plate 4.

Figure 5:
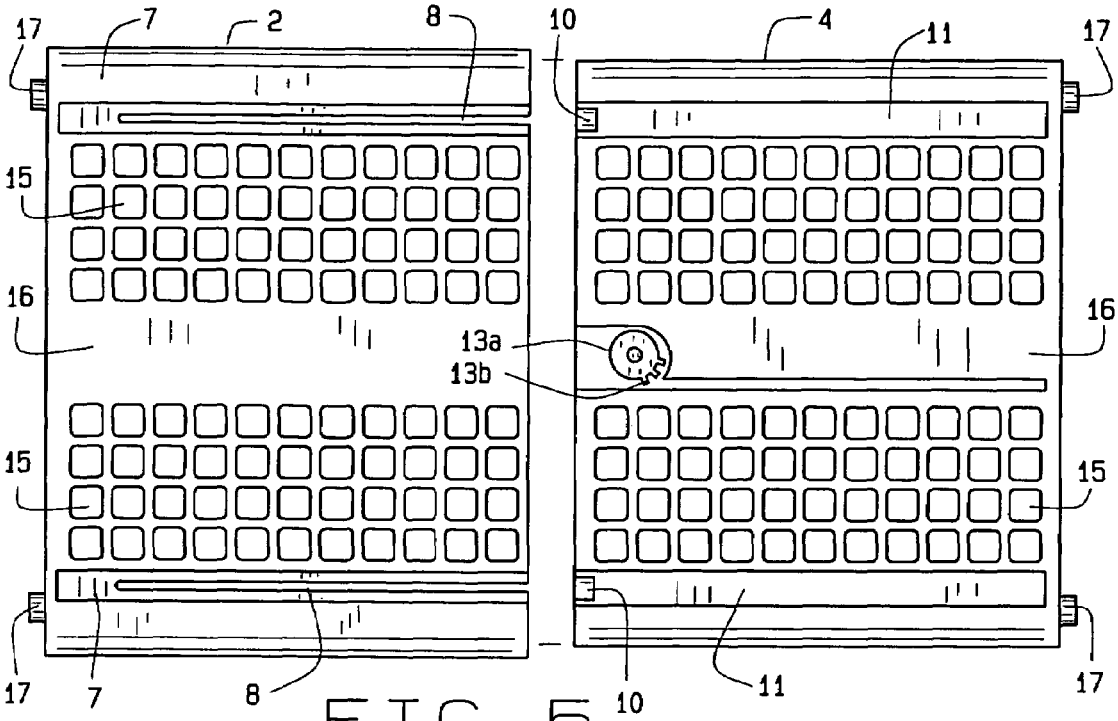
FIG. 5 illustrates the crank of the present invention.
Figure 6:
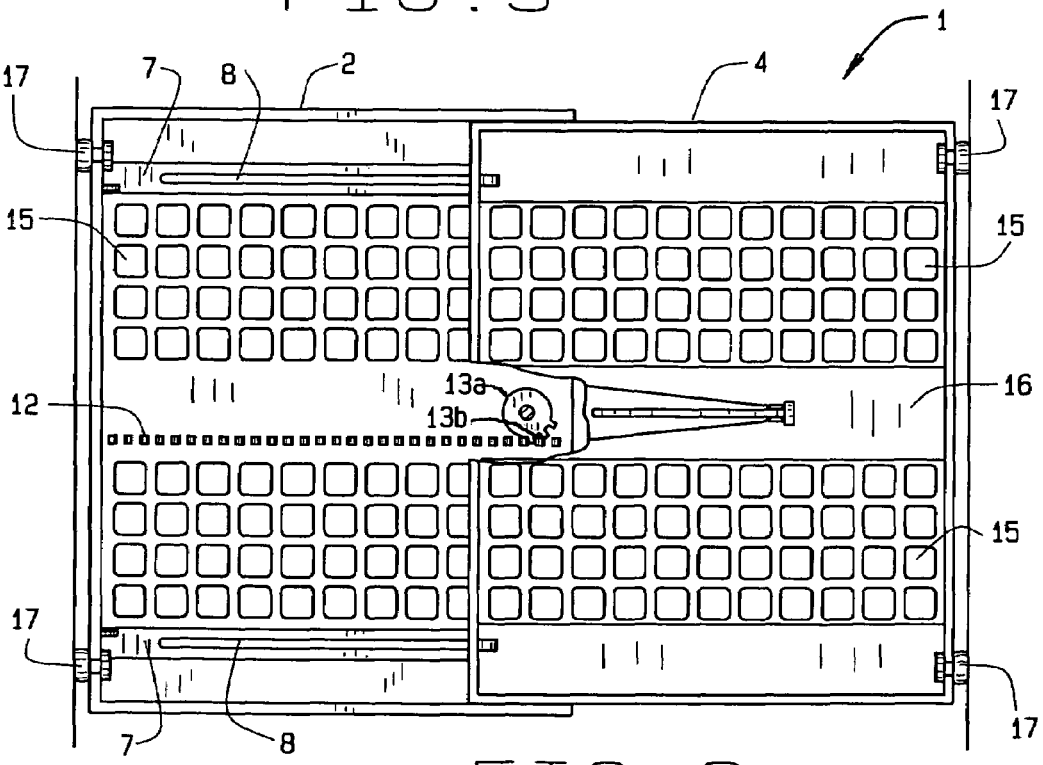
FIG. 6 shows the two plates of the shelf locked together.

The crank 13 appears alone in FIG. 5. As before, the head 13*a* has a round flat shape with two or more teeth 13*b* extending radially. Via a stem 13*c* through the second plate 4, the head 13*a* attaches to the handle 13*d*. Proximate to the head 13*a*, the handle 13*d* has a rounded end where the head 13*a* and teeth 13*b* fit within the shape of the handle 13*d*. Away from the head 13*a*, the handle 13*d* tapers in width as an elongate form. As shown in FIG. 4, the handle 13*d* has reinforcement perpendicular and beneath the handle 13*d*, opposite of the head 13*a*. In the preferred embodiment, the reinforcement is a triangular shaped rib 13*e* where the point of the triangle approaches the stem 13*c*. At the opposite end of the rib 13*e*, a grip 13*f* attaches to the rib 13*e* beneath the handle 13*d* and the second plate 4. In the preferred embodiment, the grip 13*f* has a rectangular shape within the width of the handle 13*d*.

In use, a user places the lip 3 on a lateral edge 4*b* of the second plate 4 opposite the pads 17 into the first plate 2 where no lip 3 is present. The lips 3 of the second plate 4 pass upon the glides 8 and slide beneath the surface of the first plate 2. The second plate 4 within the first plate 2 forms the shelf 1. The user then inserts the shelf 1 at an angle into a locker. The user then levels the shelf 1, extends the first plate 2 and the second plate 4 outwards against the locker walls, and then reaches beneath the shelf 1 to grasp the crank 13. Turning the crank 13, the user extends the second plate 4 relative to the first plate 2 then induces more friction between the pads 17 and the locker walls when the teeth 13*b* engage the rack 12 as the user turns the crank 13 for a tight fit of the 1 shelf. When the crank 13 reaches the longitudinal axis of the shelf 1, the user places the rib 13*e* within the stops 14 to fix the crank 13 in place and the width of the shelf 1.

Variations or modifications to the subject matter of this invention may occur to those skilled in the art upon reviewing the summary of the invention as defined herein, and upon undertaking a study of the description of its preferred embodiment. Such variations, if within the spirit of this development, are intended to be encompassed within the scope of the invention as shown and described herein. The specific depiction of the invention, as described, and as shown in the drawings, is set forth for illustrative purposes only.

From the aforementioned description, an adjustable shelf has been described. The adjustable shelf is uniquely capable of extending one plate relative to another plate to adjust the width of a shelf to meet various widths. The adjustable shelf and its various components may be manufactured from many materials including but not limited to polymers, high density polyethylene HDPE, polypropylene PP, polyethylene terephalate ethylene PETE, polyvinyl chloride PVC, polystyrene PS, nylon, ferrous and non-ferrous metals, their alloys, and composites.

I claim:

1. A device adapted to be inserted within a locker against its walls, comprising:

a first plate, generally rectangular in shape having two longitudinal edges, one lateral edge perpendicular to said longitudinal edges, and depending lips upon said longitudinal edges and said lateral edge;

a second plate, generally rectangular in shape, slightly narrower and shallower than said first plate, having two longitudinal edges and two lateral edges perpendicular to said longitudinal edges, and depending lips on all edges of said second plate nesting within said first plate;

a means for telescoping said second plate longitudinally from said first plate;

a means to temporarily secure said second plate relative to said first plate;

said means for telescoping having two mutually parallel spaced apart depressed tracks upon the surface of said first plate and each track having a longitudinal slot, each slot opening at the edge of the first plate where the second plate telescopes therein, and two glides upon the lip of said longitudinal edge opposite said lateral edge whereby the lips of said longitudinal edges of said second plate pass along said glides, and two spaced apart keys proximate to one lateral edge on the surface of said second plate proximate the location of the open ends of the first plate longitudinal slots, so as to allow the keys to insert and ride within the slots when the two plates are telescoped together;

each track having a gusset depending from the surface of said first plate and contiguous with said lip upon said lateral edge of said first plate;

each track having gusset depending from the surface of said second plate beneath said keys and contiguous with said lip proximate to said keys;

said securing means having a toothed rack extending longitudinally beneath the surface of the first plate, and extending its longitudinal length, said rack having teeth regularly spaced along a line parallel to the longitudinal axis of said first plate;

a crank connecting with said second plate, said crank having a circular head flush with the surface of said second plate and two or more teeth extending radially from the circumference of said head, a stem depending beneath said head, a handle connecting to said stem beneath the surface of said second plate and extending radially away from said stem a substantial distance more than half of the length of said second plate, a rib beneath said handle, and a grip depending from said rib opposite said stem, and a pair of stops mutually parallel and spaced apart depending from the surface of said second plate a substantial distance away from said stem wherein said rib fits between said stops to prevent said crank from rotating;

the lateral edge of said first plate as two or more pads, and a lateral edge of said second plate has two or more pads opposite said securing means; and whereby when said device is inserted into a locker, said first plate is placed next to a wall and said second plate is placed next to an opposite wall, said telescoping means positions said device against the walls of a locker and said securing means when tightened prevents relative movement of said first plate and said second plate once adjusted and tightened, and thus said device biases against the locker walls and is capable of supporting a load.

2. The device of claim 1 wherein said first plate and said second plate each have a pattern of holes upon their respective surfaces and a solid strip along the longitudinal axis to support said securing means.

* * * * *